US012082673B2

(12) United States Patent
Spivey, Jr.

(10) Patent No.: US 12,082,673 B2
(45) Date of Patent: Sep. 10, 2024

(54) DUAL COMB COMBINATION

(71) Applicant: John Spivey, Jr., Youngstown, OH (US)

(72) Inventor: John Spivey, Jr., Youngstown, OH (US)

( * ) Notice: Subject to any disclaimer, the term of this patent is extended or adjusted under 35 U.S.C. 154(b) by 151 days.

(21) Appl. No.: 18/045,226

(22) Filed: Oct. 10, 2022

(65) Prior Publication Data

US 2023/0116773 A1 Apr. 13, 2023

Related U.S. Application Data

(60) Provisional application No. 63/254,223, filed on Oct. 11, 2021.

(51) Int. Cl.
*A45D 24/06* (2006.01)

(52) U.S. Cl.
CPC ..... *A45D 24/06* (2013.01)

(58) Field of Classification Search
CPC ..... A45D 24/00; A45D 24/04; A45D 24/06; A45D 24/08; A45D 24/12; A45D 24/18; A45D 24/30; A45D 24/36; A45D 24/42; A45D 2/42; A45D 2/122; A45D 2/145; A45D 8/12; A45D 8/30; A45D 8/20; A45D 8/22; A45D 8/24; A45D 8/26; A45D 1/18; A01K 13/002; A46B 15/0055; A46B 15/0059; A46B 5/0004; A46B 5/0016; A46B 5/002; A46B 5/0041; A46B 5/0045; A46B 5/0054; A46B 5/0058; A46B 5/0087; A46B 2200/104; B26B 1/04; B26B 11/001; B26B 11/003

See application file for complete search history.

(56) References Cited

U.S. PATENT DOCUMENTS

| | | | | |
|---|---|---|---|---|
| 3,603,323 | A * | 9/1971 | Avella | A45D 24/04 132/131 |
| 5,365,952 | A * | 11/1994 | Noble | A45D 24/36 132/129 |
| 6,240,928 | B1 * | 6/2001 | DaSilva | A45D 24/16 132/145 |
| 7,089,945 | B1 * | 8/2006 | Barge | A45D 24/04 132/129 |
| 2010/0252059 | A1 * | 10/2010 | Peverini | A45D 24/16 132/129 |
| 2014/0366908 | A1 * | 12/2014 | Shevlin | A45D 24/34 132/135 |
| 2017/0055662 | A1 * | 3/2017 | Taylor | A45C 11/324 |
| 2020/0229573 | A1 * | 7/2020 | Penaflor | A45D 24/36 |
| 2022/0031039 | A1 * | 2/2022 | Fellows | A46B 15/0059 |

* cited by examiner

*Primary Examiner* — Cris L. Rodriguez
*Assistant Examiner* — Karim Asqiriba
(74) *Attorney, Agent, or Firm* — Harpman & Harpman

(57) ABSTRACT

A folding comb including two distinct comb segments that are pivotally connected to one another for independent deployment. Each comb segment has a plurality of different size and directional orientation teeth to accommodate different hair types and styles in a compact configuration. An interlocking hub hinge provides locked closed and locked open position orientation of the comb segments for use.

2 Claims, 4 Drawing Sheets

DUAL COMB COMBINATION

This application claims the benefit of U.S. Provisional Application No. 63/254,223, filed Oct. 11, 2021.

BACKGROUND OF THE INVENTION

1. Technical Field

This invention is directed to the field of hair grooming and more specifically hair combs which are used to style and manage different types of human hair.

2. Description of Prior Art

Hair grooming requires hair directed tools such as hairbrushes and combs to manage and style and for use during cutting. A number of hairbrushes and comb configurations have been developed to assist individuals in maintaining their hair. Different types of hair require different comb types such as facial hair, mustache and beards, for example, that typically have different texture or coarser hair.

Certain hair styles for different types such as wiry and curly hair compound the difficulty in styling an individual's hair and requires, as noted, different hairbrushes and comb designs.

Such combs are currently available with fine narrow spaced teeth and large spaced teeth to accommodate different hairstyles and types.

Prior art examples of folding combs can be seen in U.S. Publication 2010/0252059 that has a pair of comb and brush devices pivotally together to facilitate cutting and grooming of an individual's hair.

SUMMARY OF THE INVENTION

A dual-purpose folding hair comb that combines two distinct hair grooming combs, each designed to address an individual's hair type. The dual comb has a center hub hinge fitting that provides a compact folded closed lock position and an open locked open position for access to both combs simultaneously in different comb teeth orientations in both closed and locked position.

DETAILED DESCRIPTION OF THE INVENTION

Figure 1:
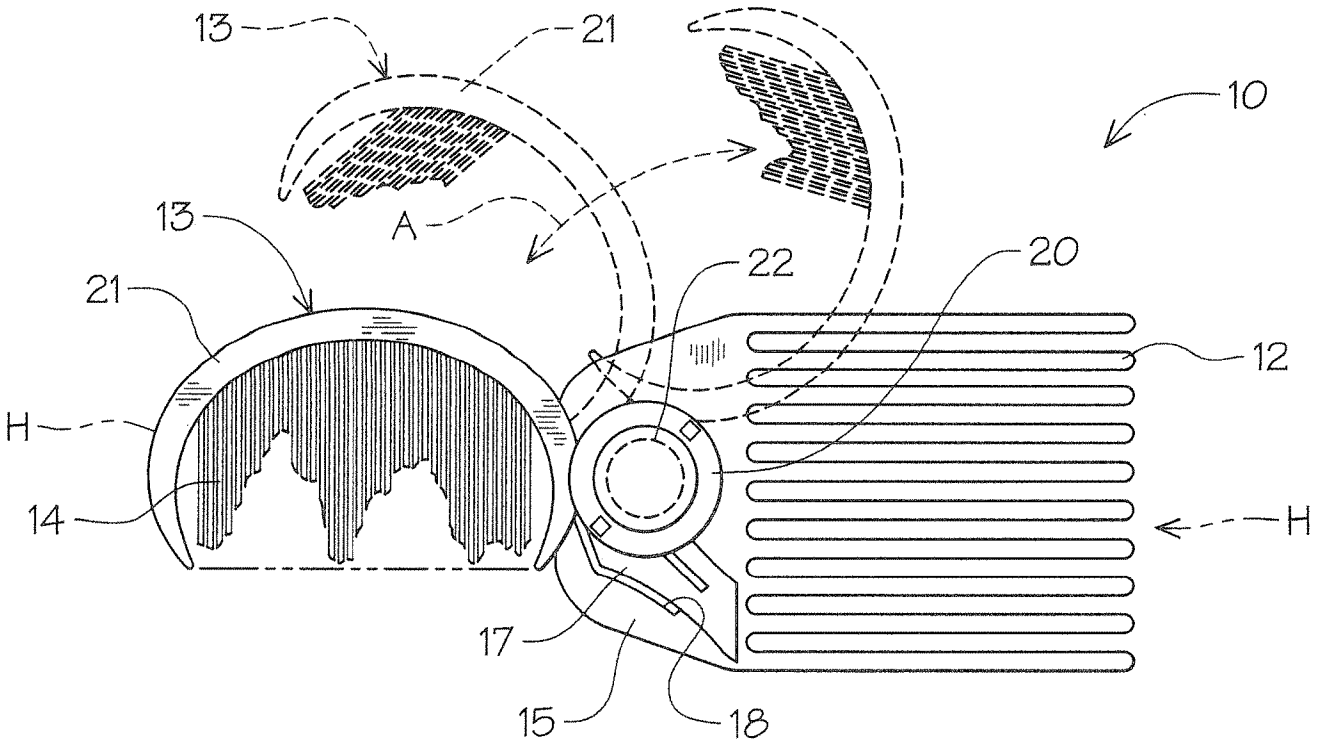
FIG. 1 is a top plan view of the dual folding comb of the invention in unfolded locked use position.
Figure 2:
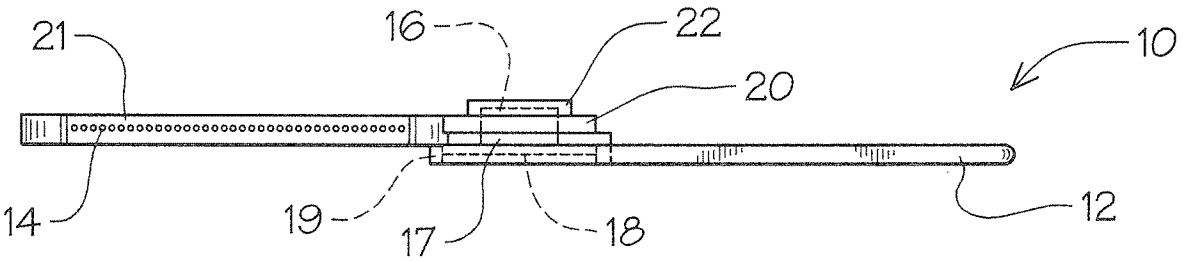
FIG. 2 is a side elevational view thereof.
Figure 3:
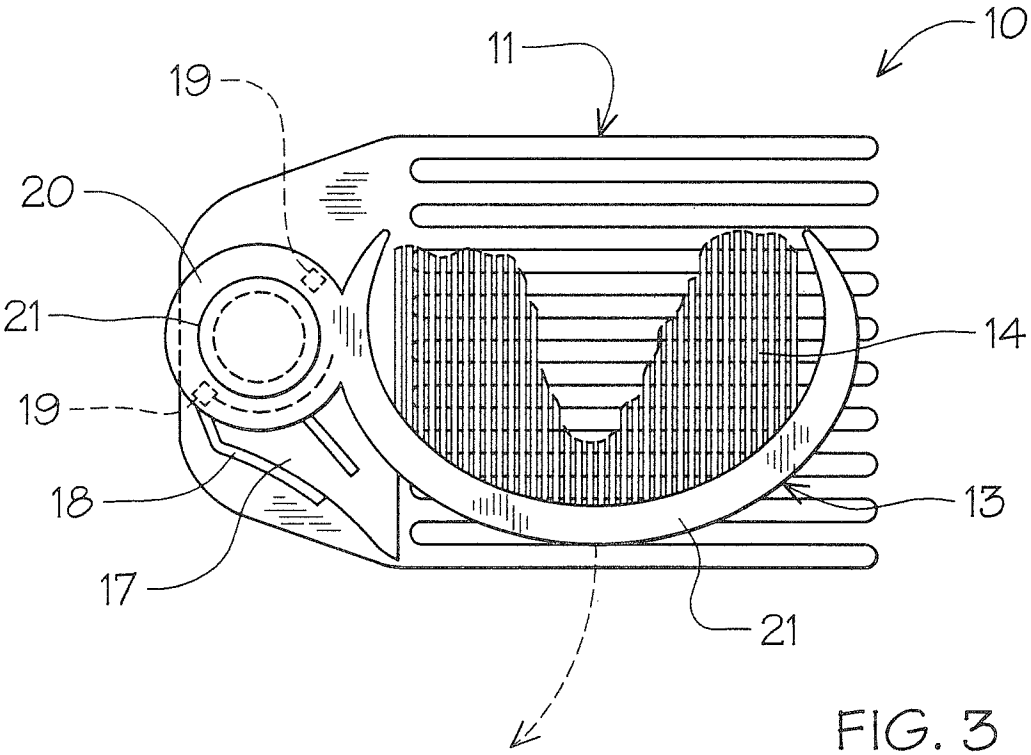
FIG. 3 is a top plan view of the dual folding comb in closed lock storage position.
Figure 4:
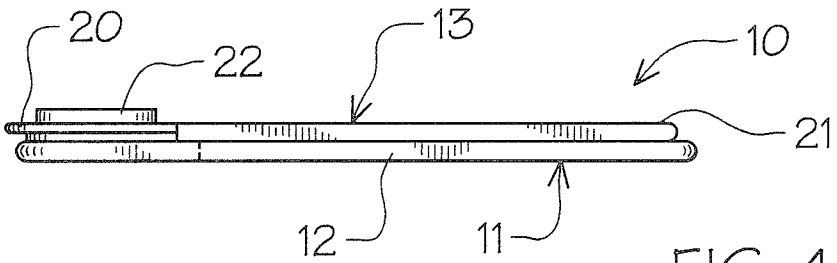
FIG. 4 is a front elevational view thereof.
Figure 5:
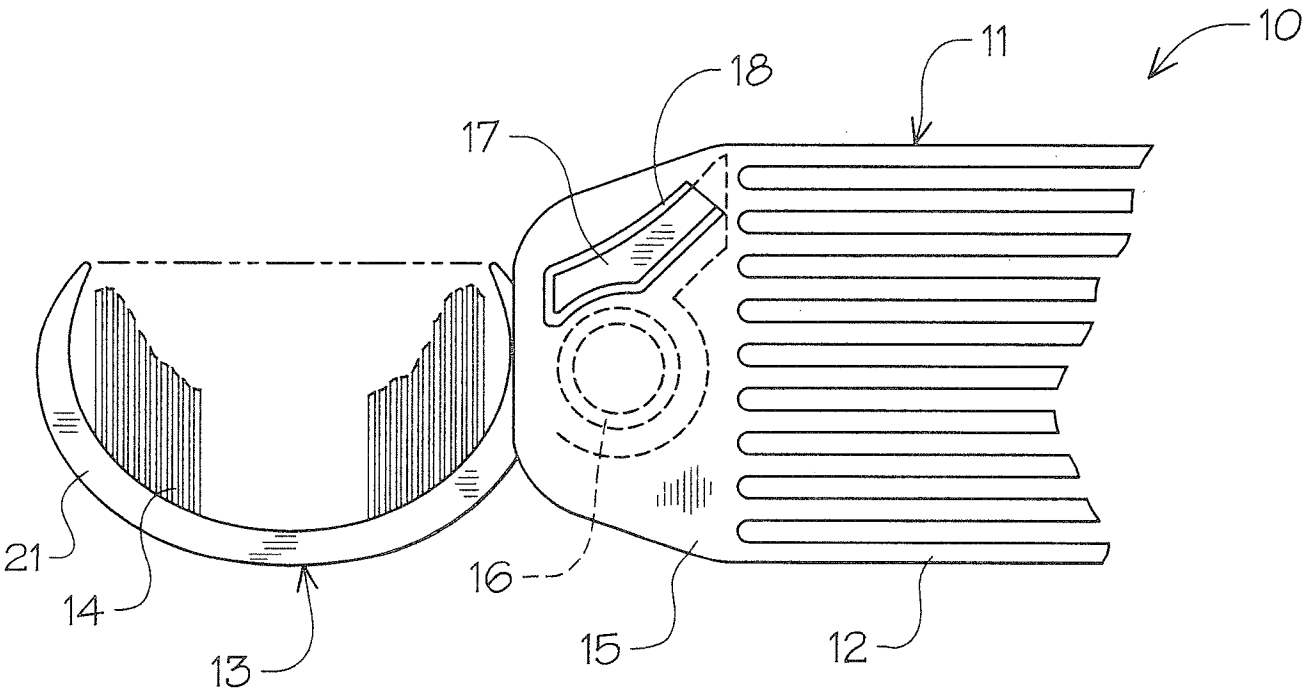
FIG. 5 is a bottom plan view of the extended open lock folding comb of the invention.

Referring to FIGS. 1, 2 and 3 of the drawings, a dual folding comb 10 of the invention can be seen in open locked use position. The comb 10 has a first comb portion 11 characterized by a plurality of large spaced parallel teeth 12 and a secondary contoured comb portion 13 with a plurality of closely spaced small teeth 14 pivotally secured thereto.

In this orientation, the secondary comb portion 13 is illustrated by broken lines pivoting from an open use position towards a closed lock right angular oriented position, best seen in FIGS. 1 and 3 of the drawings. The larger parallel multiple teeth 12 of the first comb portion 11 extend integrally from a flat support base 15 having an upstanding annular split hinge ring 16 thereon. A resilient hinge lock element 17 extends from within the base portion 15 in a contoured cut out 18 allowing the hinge lock element 17 to flex under hinge engagement as will be described hereinafter.

Figure 6:
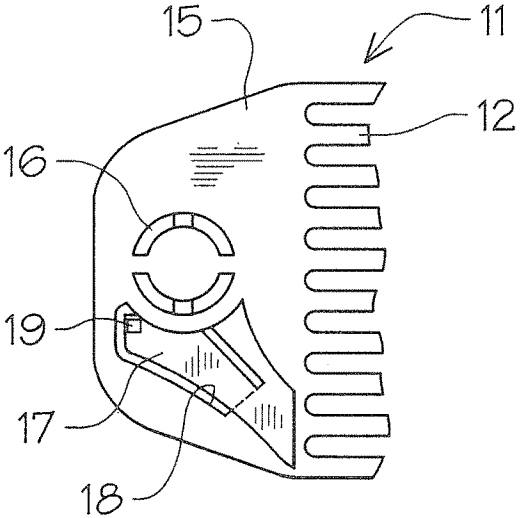
FIG. 6 is a partial top plan view of the hinge base first comb portion of the comb.

The resilient hinge lock element 17 has an upstanding locking pin 19 on its free end as best seen in FIGS. 1 and 3 of the drawings in broken lines and in FIG. 6 in solid lines.

The secondary contoured comb portion 13 has an annular hinge engagement base portion 20 with a curved comb teeth support shank 21 extending therefrom with the plurality of parallel small teeth 14 extending at right angles thereto.

Figure 7:
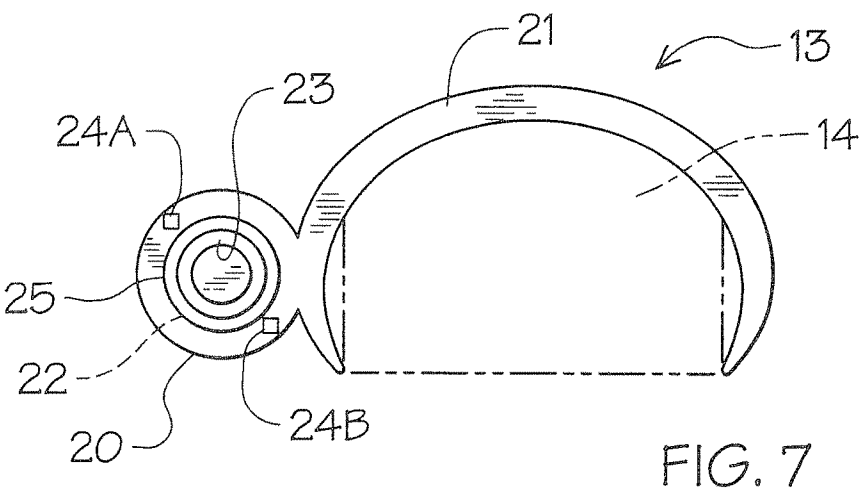
FIG. 7 is a partial bottom plan view of the hinge base second comb portion

The annular hinge engagement base 20 has an upstanding annular center portion 22 which defines a hinge receiving recess 23 on its oppositely disposed side, as best seen in FIG. 7 of the drawings. A pair of spaced opposing pin registration recesses 24A and 24B within the base 20 positioned adjacent the hinge receiving recess 23 which has an upstanding flange 25 there about provides for open and closed pin 19 registration during use. It will therefore be evident that when the lock closed position of a locking pin 19 is therefore resiliently engaged in the pin recess 24A as seen in FIG. 3 of the drawings.

In operation, as the second comb portion 13 is rotated (clockwise in this view) indicated by arrow A, resilient lock hinge element 17 with the pin 19 thereon deflects and is then registerably received upon completion of rotation and the pin recess 24B shown in FIG. 1 of the drawings thereby locking the dual folded comb in open locked position, as noted. The resilient hinge lock element 17 thereby provides frictional rotational resistance via the engagement of the pin 19 as respective comb portions 11 and 13 rotate about the defined hinge assembly. This action imparts an appropriate resistance between the comb portion maintaining the intermediate "no slip" positions.

It will be seen that the dual folding comb 10 thereby provides a pair of independent deployable comb configurations which may be used in style treatment of different hair conditions by drawing the hair past and through the respective comb portion's large teeth 12 and small teeth 14 to engage and style the hair appropriately.

In the "locked" open use position, the comb 10 of the invention with respective first and second comb portions 11 and 13 act as oppositely disposed opposing handles H depending on which comb portion is being used. It will be readily apparent that the unique comb portion's orientation when in closed lock position as seen in FIG. 3 of the drawings wherein the secondary contoured comb portion 13 overlies in this view the first comb portion 11 in a right angular orientation thereby stabilizing and protecting the respective comb's teeth 12 and 14 for storage and transport which is unique and novel to the invention.

Figure 8:
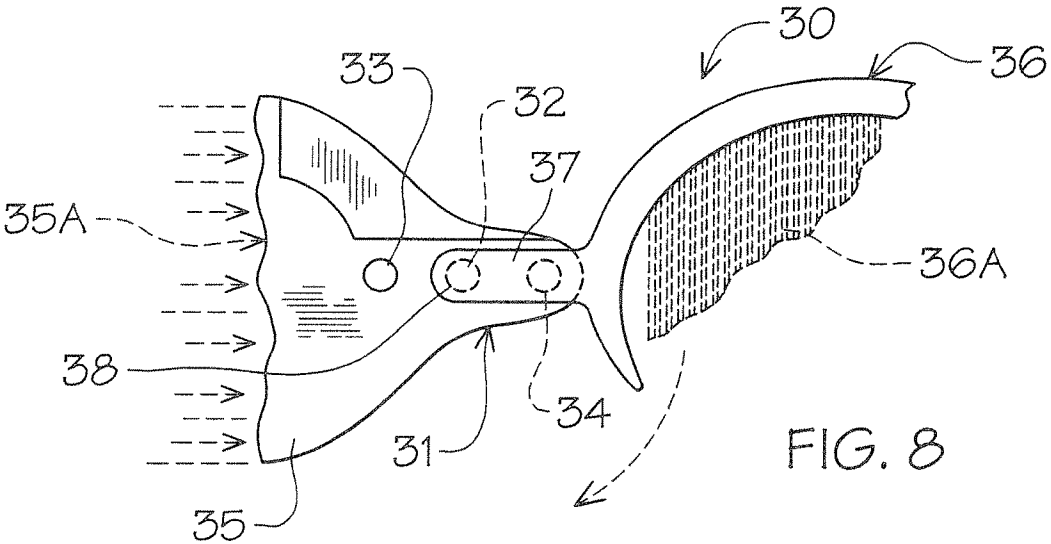
FIG. 8 is a partial top plan view of an alternate pivoting hinge configuration for a comb combination.

Referring now to FIG. 8 of the drawings, an alternate hinge 30 configuration can be seen wherein a simple pivot hinge 31 is disclosed. As noted, such hinge assembly variations would be evident with the central hinge pivot post 32 with spaced opposing locking pins 33 and 34 on a base comb portion 35 with large spaced teeth 35A. A contoured comb portion 36 with small teeth 36A is illustrated as having a hinge arm 37 with a pin receiving recess at 38 therein which will provide for selective illustration in closed and open position. This alternate form of the invention will still maintain the unique comb portion's right angular orientation when in closed position and in open position which is again critical and unique to the invention to provide both ease of use associated with the comb's configuration as well as the angular orientation when in stored transport position protecting the teeth and providing a compact self-contained unit.

It will thus be seen that a new and novel dual folding comb of the invention has been illustrated and described and it will be apparent to those skilled in the art that various changes and modifications may be made therein without departing from the spirit of the invention.

Therefore I claim:

1. A folding dual comb comprising, a first comb portion and a second comb portion pivotally secured together, said first comb portion having a plurality of teeth extending longitudinally in spaced parallel relation to one another from a flat support base with an annular upstanding hinge ring, said second comb portion having an annular hinge engagement base portion, a contoured teeth support shank extending therefrom, a plurality of teeth extending in spaced parallel relation to one another transversely from said support shank, said hinge ring registerably received in said annular hinge engagement base portion, said second comb portion movable from a first closed storage position overlying said second comb portion to a second use position in extended longitudinal alignment with said first open comb portion, said plurality of teeth of said respective comb portions in right angular orientation to one another, a resilient hinge lock within a cut out extends from said first comb portion flat support base, an upstanding locking pin on said hinge lock for selective registration in a hinged receiving recess in said second comb hinge engagement base portion defining lock pin closed storage and open lock use positions.

2. The folding dual comb set forth in claim 1, wherein said teeth extending from said support shank are of a known dimension less than that of said longitudinally extending teeth of said first comb portion.

* * * * *